United States Patent [19]

Yu

[11] Patent Number: 5,013,624

[45] Date of Patent: May 7, 1991

[54] GLASSY METAL OXIDE LAYERS FOR PHOTORECEPTOR APPLICATIONS

[75] Inventor: Robert C.U. Yu, Webster, N.Y.

[73] Assignee: Xerox Corporation, Stamford, Conn.

[21] Appl. No.: 451,006

[22] Filed: Dec. 15, 1989

[51] Int. Cl.[5] ..... G03G 15/00; G03G 15/04

[52] U.S. Cl. ..... 430/60; 430/50; 430/65

[58] Field of Search ..... 430/60, 65

[56] References Cited

U.S. PATENT DOCUMENTS

| | | | |
|---|---|---|---|
| 4,232,102 | 11/1980 | Horgan et al. . | |
| 4,233,283 | 11/1980 | Ado et al. . | |
| 4,265,990 | 5/1981 | Stolka et al. . | |
| 4,358,486 | 11/1982 | Ecord et al. . | |
| 4,457,971 | 7/1984 | Caldwell et al. . | |
| 4,464,450 | 8/1984 | Teuscher et al. . | |
| 4,559,288 | 12/1985 | Nakao et al. . | |
| 4,587,189 | 5/1986 | Hor et al. . | |
| 4,753,827 | 6/1988 | Yoldas et al. . | |
| 4,754,012 | 6/1988 | Yoldas et al. . | |
| 4,786,570 | 11/1988 | Yu et al. . | |
| 4,799,963 | 1/1989 | Basil et al. | 106/287.13 |
| 4,921,731 | 5/1990 | Clark et al. | 427/314 |

OTHER PUBLICATIONS

Schaefer et al., "Fractal Geometry of Silica Condensation Polymers", Physical Review Letters, vol. 53, No. 14, Oct. 1, 1984, pp. 1383-1386.

Mark et al., "Simultaneous Curing and Filling of Elastomers", Macromolecules, 1984, vol. 17, pp. 2613-2616.

Brinker et al., "Sol-Gel Transition in Simple Silicates II", Journal of Non-Crystalline Solids, vol. 63, pp. 45-59, 1984.

G. Wilkes et al., "Ceramers: Hybrid Materials Incorporating Polymeric/Oligomeric Species into Inorganic Glasses Utilizing a Sol-Gel Approach", ACS Polymer Reprints 26(2) 1985, pp. 300-301.

R. Roy et al., "Multi-Phasic Ceramic Composites Made by Sol-Gel Technique", *Mat. Res. Soc. Symp. Proc.*, vol. 32 (1984), pp. 347-359.

*Primary Examiner*—Marion E. McCamish
*Assistant Examiner*—Stephen Crossan
*Attorney, Agent, or Firm*—Oliff & Berridge

[57] ABSTRACT

An electrophotographic imaging member has a metal oxide hole blocking layer in the form of a film of an inorganic glassy network. The metal oxide hole blocking layer may be bonded to a conductive layer of the imaging member.

20 Claims, 1 Drawing Sheet

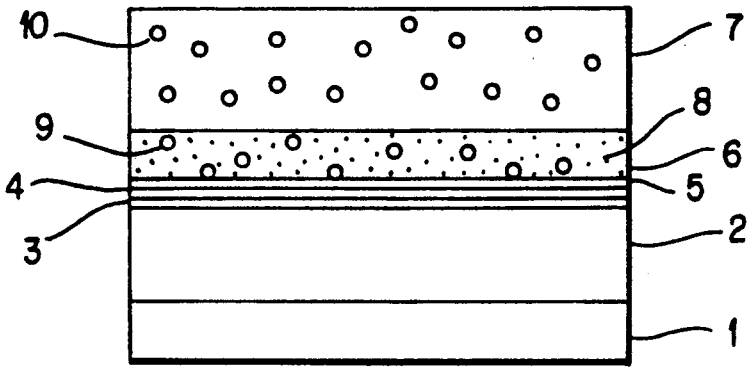
10
7
9
8
6
4
5
3
2
1

GLASSY METAL OXIDE LAYERS FOR PHOTORECEPTOR APPLICATIONS

BACKGROUND OF THE INVENTION

This invention relates in general to electrophotography and, in particular, to electrophotographic imaging members and processes for preparing the imaging members.

In electrophotography, an electrophotographic plate containing a photoconductive insulating layer on a conductive layer is imaged by first uniformly electrostatically charging its surface. The plate is then exposed to a pattern of activating electromagnetic radiation, such as light. The light selectively dissipates the charge in the illuminated areas of the photoconductive insulating layer while leaving behind an electrostatic latent image in the non-illuminated area. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material or may be a composite containing a photoconductor and another material.

One type of multilayered photoreceptor which has been employed as a belt in electrophotographic imaging systems is described in U.S. Pat. No. 4,786,570 to Yu et al. This electrophotographic imaging system comprises a substrate, a conductive layer, a hole blocking layer, an adhesive layer, a charge generating layer, and a charge transport layer. This photoreceptor may also comprise additional layers such as an anti-curl back coating and an overcoating layer. In this imaging member, the hole blocking layer may comprise a reaction product between a hydrolyzed silane and an oxidized surface of a metal ground plane layer.

In fabricating electrophotographic imaging members, there is a need for materials which can be easily prepared and which have greater mechanical stability. There are known a number of methods and materials for forming electrophotographic imaging members.

The sol-gel process allows the preparation of a variety of inorganic ceramic glasses at low temperatures. Generally, a sol is formed from a suspension of liquid chemicals in a solvent. The sol is then polymerized and crosslinked through condensation to form a gel. A crosslinked glassy network is ultimately obtained by drying the gel to remove solvent trapped in the condensed product.

The concept of the sol-gel process is known and has been employed in various fields. For example, Yoldas et al in U.S. Pat. Nos. 4,753,827 and 4,754,012 disclose organoalkoxysilane/metal oxide sol-gel compositions which are abrasion-resistant, and a method for their production. An organoalkoxysilane or mixture of organoalkoxysilanes is mixed with a metal alkoxide or mixture of metal alkoxides. The mixture is hydrolyzed, condensed and dried to form an organosiloxane/metal oxide abrasionresistant coating.

Roy et al, "Multi-phase Ceramic Composites Made by SolGel Technique," Mat. Res. Soc. Symp. Proc., vol. 326, 1984, discloses the formation of photoconductive foams or species such as ZnO and CdS dispersed in inorganic gels.

Thin films of hybrid material composed of a silica network and polysiloxane flexible subunits have been disclosed by G. L. Wilkes et al, "Ceramics: Hybrid Materials Incorporating Polymeric/Oligomeric Species Into Inorganic Glass Utilizing a Sol-Gel Approach," Polymer. Prep., vol. 26, No. 3, page 300, 1985. The hybrid material was prepared by the hydrolysis and condensation of tetraethylorthosilicate (TEOS) to produce hydroxy terminated silicate, which is reacted with hydroxy terminated polydimethylsiloxane.

Although excellent toner images may be obtained with multilayered belt photoreceptors, it has been found that numerous layers limit the versatility of the multilayered belt photoreceptor. For example, there is a great need for flexible, long service life belt photoreceptors in compact imaging machines that employ small diameter support rollers due to the very confined space. Small diameter support rollers also allow for reliable copy paper stripping using the beam strength of the copy paper to remove it from the surface of a photoreceptor belt after toner image transfer. These small diameter rollers raise the threshold of mechanical performance criteria to such a high level that spontaneous photoreceptor belt material failure becomes a frequent event. Cracking may be encountered in one or more of the photoreceptor layers during belt cycling over small diameter rollers.

Moreover, multilayered belt photoreceptors tend to delaminate during extended cycling over small diameter support rollers. Alteration of materials in the various belt layers such as the conductive layer, hole blocking layer, adhesive layer, charge generating layer, and/or the charge transport layer to reduce delamination is not easily effected because the new materials may adversely affect the overall electrical, mechanical and other properties of the belt such as residual voltage, background, dark decay, flexibility and the like.

In multilayered photoreceptors, it is desirable not only to maintain the electrical and mechanical integrity of the device, but also to provide simple fabrication processes.

SUMMARY OF THE INVENTION

It is an object of the invention to provide an imaging member having a multilayered structure which overcomes the shortcomings of the prior art.

It is a further object of the invention to provide a multilayered photoreceptor which resists delamination while retaining its electrical and mechanical properties.

It is an object of the invention to provide a hole blocking layer having a glassy network which may chemically bond to a ground plane of a multilayered photoreceptor.

It is a further object of the invention to provide a method for solution casting a hole blocking layer of metal oxide in the fabrication of a multilayered imaging device.

It also is an object of the invention to provide material in one layer of an imaging device which will chemically bond with an adjacent layer. This may be achieved by providing a glassy network of material which covalently bonds with a material of the adjacent layer. The glassy network may be a network containing metal oxide.

It is a further object of the present invention to provide a layered photoresponsive imaging member with a photogenerating layer situated between a supporting substrate bearing a hole blocking layer comprised of metal oxide in contact with a ground plane layer and a charge, especially hole, transport layer.

These and other objects of the present invention are accomplished in layered imaging members comprised, for example, of a ground plane, a glassy metal oxide hole blocking layer, a photogenerating layer and a charge transport layer. More specifically, the present invention encompasses layered imaging members comprised of a supporting substrate, a conductive ground plane layer, a hole blocking metal oxide layer, an adhesive layer, a photogenerating layer, and a charge transport layer.

The present invention can be used in a layered photoconductive imaging member comprised of a supporting substrate, in contact therewith a ground plane layer, a hole blocking metal oxide layer in contact with the ground plane layer, a photogenerating layer and in contact therewith a charge, preferably hole, transport layer.

BRIEF DESCRIPTION OF THE DRAWINGS

A more complete understanding of the process and product of the present invention can be obtained by reference to the Figure which is a schematic cross-sectional view of a multilayered photoreceptor of the present invention.

DETAILED DESCRIPTION OF PREFERRED EMBODIMENTS

The photoresponsive imaging members of the present invention can be prepared by a number of known methods, the process parameters and the order of the coating of the layers being dependent on the member desired. Thus, for example, the photoresponsive members of the present invention can be prepared by providing a substrate with a conductive ground plane, and a metal oxide hole blocking layer, and applying thereto a photogenerating layer, and overcoating thereon a charge transport layer. The photoresponsive imaging members of the present invention can be fabricated by known coating techniques such as dip coating, drawbar coating, or spray coating, depending mainly on the type of imaging devices desired. Each coating can usually be dried, for example, in a convection or forced air oven at a suitable temperature before a subsequent layer is applied thereto.

The Figure shows an imaging device of the present invention having an anti-curl layer 1, a supporting substrate 2, an electrically conductive ground plane 3, a hole blocking layer 4, an adhesive layer 5, a charge generating layer 6, and a charge transport layer 7.

According to the invention, material is incorporated in one layer of an electrophotographic device which will bond with material of an adjacent conductive layer. For example, a glassy network of metal oxide may be provided as a hole blocking layer in an imaging device. This glassy network is capable of bonding with material present in a conductive layer of the device, such as titanium. Strong covalent bonds may be formed with the material in the conductive layer, providing a more mechanically stable device.

A specific example of the invention will be discussed herein which is particularly directed to a novel method of producing a blocking layer 4 which may be covalently bonded to a conductive ground plane 3, as well as to novel devices formed therewith.

The supporting substrate layer 2 of the invention may be of any suitable conductive material, e.g., aluminum, steel, brass, graphite, dispersed conductive salts, conductive polymers or the like. When a conductive supporting substrate is used, the need for the conductive ground plane 3 is eliminated. The substrate may be opaque or substantially transparent, and may comprise numerous suitable materials having the required mechanical properties. Accordingly, the substrate may comprise a layer of an electrically non-conductive or conductive material such as an inorganic or organic composition. As electrically non-conductive materials there may be employed various resins known for this purpose including polyesters, polycarbonates, polyamides, polyurethanes, and the like. The electrically insulating or conductive substrates should be flexible and may have any number of different configurations such as, for example, a sheet, a scroll, an endless flexible belt or the like. Preferably, the substrate is in the form of an endless flexible belt and comprises a commercially available biaxially oriented polyester known as Mylar, available from E. I. du Pont de Nemours & Co., or Melinex, available from ICI, or Hostaphan from American Hoechst Corporation. The thickness of the substrate layer is dependent on many factors including, for example, the components of the other layers. Generally, the substrate is of a thickness of from about 75 micrometers to about 200 micrometers.

The ground plane layer 3 may comprise any electrically conductive material. For example, a metal layer which will chemically bond with the hole blocking layer 4 of the present invention may be used. The ground plane layer 3 may be formed on the substrate 2 by any suitable coating technique. Typical metals for use in the ground plane layer 3 include aluminum, zirconium, copper, gold, niobium, tantalum, vanadium, hafnium, titanium, nickel, stainless steel, chromium, tungsten, molybdenum, and the like. Other materials capable of bonding with the material of the hole blocking layer 4 of the invention may also be used. Typical vacuum depositing techniques include sputtering, magnetron sputtering, RF sputtering and the like. If the ground plane layer is formed from a metal, the surface thereof will contain a metal oxide layer.

The ground plane 3 may vary in thickness over substantially wide ranges depending on the optical transparency and flexibility desired for the electrophotoconductive member. The thickness of the ground plane layer may preferably be between about 0.005 micrometer to about 0.2 micrometer and more preferably from about 0.01 micrometer to about 0.03 micrometer for an optimum combination of electrical conductivity, flexibility and light transmission.

The adhesive layer 5 is comprised of known adhesive materials such as copolyester resins, for example 49,000 copolyester available from du Pont, Vitel PE-100 and Vitel PE-200 copolyesters available from Goodyear, polysiloxane, acrylic polymers, and the like. A thickness of from about 0.02 micrometer to about 0.2 micrometer is generally employed for the adhesive layer.

The photogenerating layer 6 may be comprised of organic or inorganic photoconductive pigments optionally dispersed in an inactive resinous binder. Preferred photogenerating layers permit a photoresponse of from about 400 to about 700 nanometers. They include, for example, those comprised of known photoconductive charge carrier generating materials, such as amorphous selenium alloys, halogen doped amorphous selenium, halogen doped amorphous selenium alloys, trigonal selenium, mixtures of Group IA and IIA elements, selenite and carbonates with trigonal selenium, such as disclosed in U.S. Pat. Nos. 4,232,102 and 4,233,283, copper, chlorine doped cadmium sulfide, cadmium selenide and cadmium sulfur selenide, and the like. Examples of specific alloys include selenium arsenic with from about 95 to about 99.8 weight percent selenium; selenium tellurium with from about 50 to about 98 weight percent of selenium; the aforementioned alloys containing halogens such as chlorine in amounts of from about 100 to about 1,000 parts per million; ternary alloys; and the like. Also, there may be selected as photogenerators, organic components such as squaraines, perylenes, disclosed for example in U.S. Pat. No. 4,587,189, metal phthalocyanines, metal free phthalocyanines, vanadyl phthalocyanine, dibromoanthanthrone, and the like.

The thickness of the photogenerating layer 6 is dependent on a number of factors, such as the materials included in the other layers of the imaging member. Generally, however, this layer is of a thickness of from about 0.1 micrometer to about 5 micrometers and preferably from about 0.2 micrometer to about 2 micrometers depending on the photoconductive volume loading, which may vary from about 5 percent to about 100 percent by weight. Generally, it is desirable to provide this layer in a thickness which is sufficient to absorb about 90 percent or more of the incident radiation which is directed upon it in the imaging exposure step. The maximum thickness of this layer is dependent primarily upon factors such as mechanical considerations, and for example, whether a flexible photoresponsive device is desired.

Resin binders for the photogenerator are present in effective amounts of, for example, from about 5 to about 25 weight percent. Such resin binders include polyvinylcarbazole, polyvinylbutyral, polyhydroxyether, and the like.

The charge transport layer 7 may comprise, for example, aryl amines as illustrated in U.S. Pat. No. 4,265,990, which aryl amines may be optionally dispersed in an inactive resin binder, N,N-bis(biarylyl)aniline polymers, stilbenes, pyrazolenes, polymers thereof, polyvinylcarbazole, polysilylenes, and the like dispersed in a resin binder. Typical binders for the charge transport layer include the poly(4,4'-isopropylidenediphenyl carbonate), poly[1,1-cyclohexane bis(4-phenyl)carbonate], polyether carbonate, 4,4'-cylohexylidene diphenyl polycarbonate, polystyrene, and the like. From about 25 to 75, more preferably 40 to 60, weight percent of the binder is preferred. Examples of specific charge hole transporting components that may be selected for the charge transport layer 7 of the imaging member of the present invention include the aryl amines of the following Formula I (wherein X is independently halogen or alkyl), and preferably N,N,-diphenyl-N,N,-bis(3-methyl phenyl)-(1,1'-biphenyl)-4,4'-diamine, and those of Formulas II to XI wherein n represents the number of repeating units such as, for example, from about 10 to about 300.

I

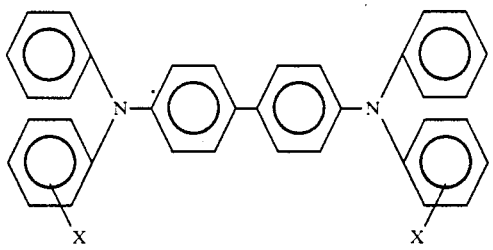

II

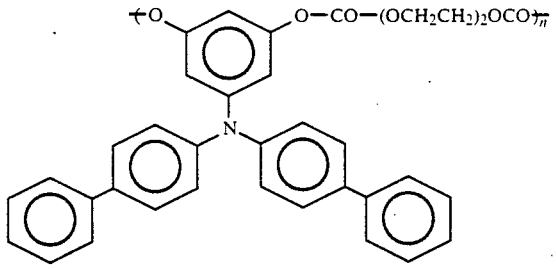

III

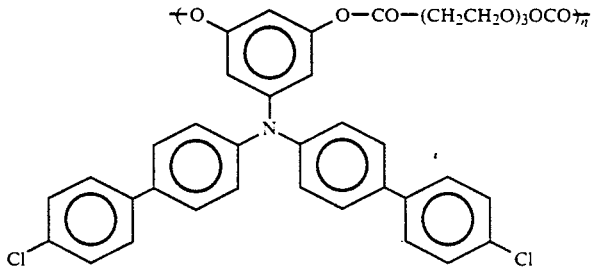

-continued
IV
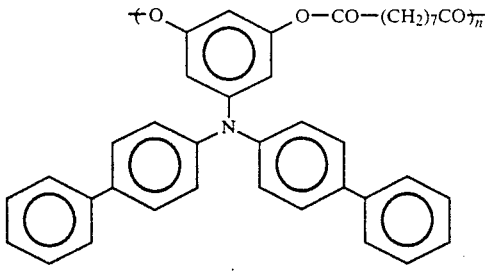
V
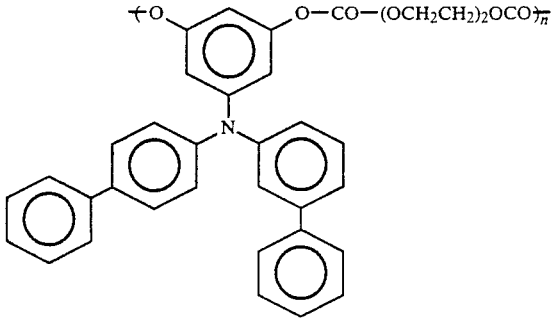
VI
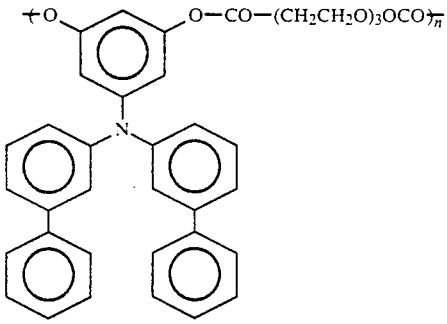
VII
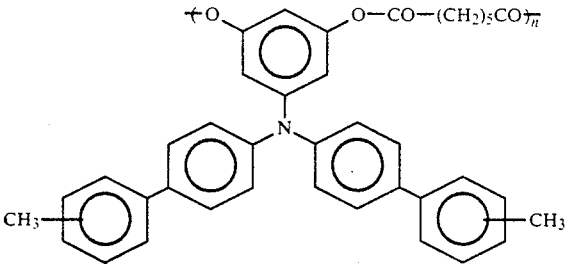
VIII
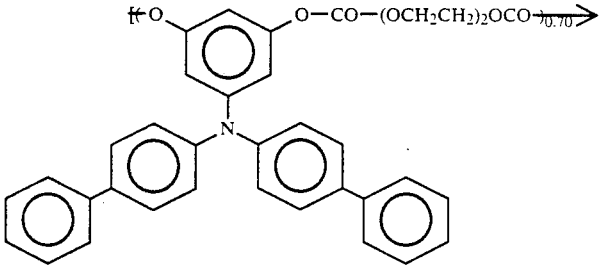

-continued

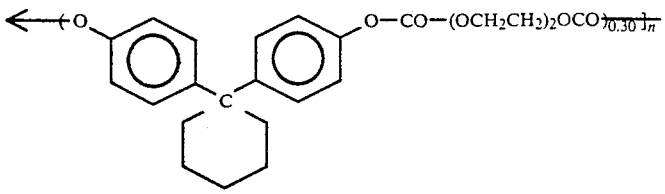

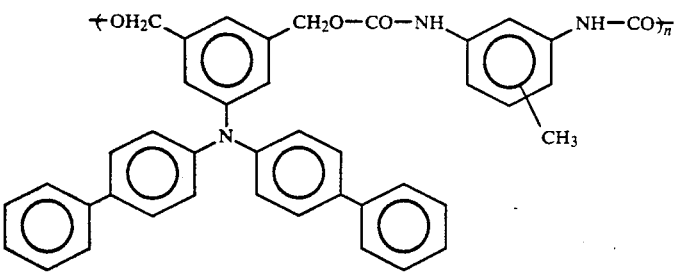

IX

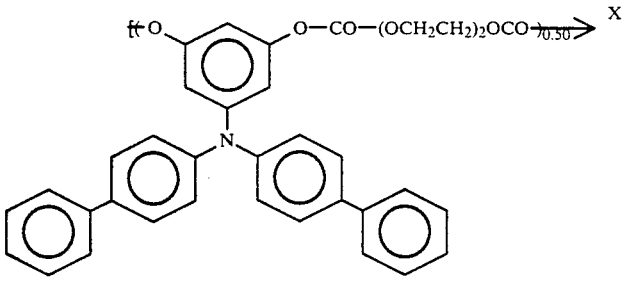

X

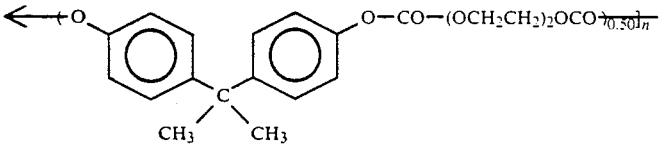

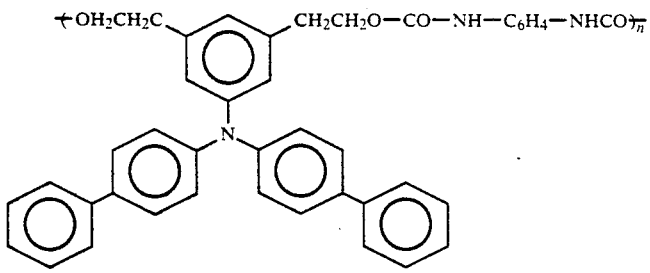

XI

The preferred charge transporting molecules are the aryl amines illustrated herein of Formula I. The charge transport layer 7 can be of any effective thickness. Generally, the thickness of the hole or charge transport layer is from about 10 to about 60 micrometers and preferably about 25 micrometers.

Anticurl layer 1 may be formed at the back side of the substrate 2, opposite to the imaging layers. The anticurl layer may comprise a film forming resin and an adhesion promoter polyester additive. Examples of film forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anticurl layer is from about 5 micrometers to about 35 micrometers, and preferably about 14 micrometers.

The hole blocking layer 4 of the present invention comprises a glassy network of, for example, metal oxide deposited on the ground plane 3 through a sol-gel process. In this process, the metal oxide film is prepared by hydrolyzing a metal alkoxide or aryloxidc of the formula $M(OR)_n$, wherein M is a metal, R is an alkyl group having 1 to 20 carbon atoms, benzyl or phenyl, and n is a valence number of the metal. The metal alkoxide or aryloxide can be any one or mixture which, after hydrolytic reaction with water in an alcohol medium and in the presence of a catalyst, will form a metal oxide film after casting onto a metallized supporting substrate and drying at elevated temperature. An example is tetraethylorthosilicate (TEOS) from Petrarch Chemical. The resulting metal oxide film should have properties which make it compatible with hole blocking needs of the photoreceptor. The metal alkoxide or aryloxide is hydrolyzed in an aqueous/alcohol medium and catalyzed by an acid or base to form a sol. Upon partial condensation of the sol, a gel having a loosely cross-linked network is formed which can be cast over a ground plane containing a material which will bond with the metal oxide units in the gel upon heating and drying. Alternatively, the sol can be directly cast on the ground plane where it undergoes hydrolysis and condensation.

The hole blocking layer may be applied to the ground plane by any of a number of well known coating techniques. For example, it can be coated by casting, extrusion coating, spray coating, lamination, dip coating, solution spin coating and the like. The thickness of the hole blocking layer may be from about 0.003 micrometer to about 0.5 micrometer, and more preferably about 0.03 micrometer to about 0.1 micrometer, depending on the effectiveness with which this layer prevents the dark injection of charge carriers into the photogenerating layer from the conductive layer underneath.

The metal oxide hole blocking layer of the invention may be covalently bonded with material in an adjacent layer, for example, the ground plane layer. Initially, the linking of the hydrolyzed species takes place through hydrogen bonding. Subsequently, the hydrolyzed species spontaneously condense and polymerize into extended molecules with branched side chains, proceeding to the development of the ultimate gel structure. Crosslinking through condensation between the branched side chains of the polymer forms the desired three-dimensional glassy network. The gel structure and/or hydrolyzed species is also attracted by hydrogen bonding to the material in the ground plane. Condensation at the hole blocking layer/ground plane interface after solution casting and heating/drying results in strong covalent bonds (e.g., metal-oxygen-silicon) between the hole blocking layer and the ground plane layer.

A layer of a glassy network of metal oxide can be obtained by controlling the reaction conditions. A glassy network may be obtained by carrying out the sol-gel reaction in an aqueous/alcohol medium in the presence of acid or base catalyst.

Metal oxide hole blocking layer coatings which can be obtained with the present invention include oxides of Si, Ti, Al, Cr, Sn, Fe, Mg, Mn, Zr, Ni, Cu, and the like. Preferred metal oxide blocking layers are formed with a glassy network of $SiO_2$-$TiO_2$, $Al_2O_3$ and the like coated over a Ti ground plane on a polyethylene terephthalate (PET) substrate. Illustrative examples of the hole blocking metal oxide layer 4 include $SiO_2$ and $SiO_2$-$TiO_2$ metal oxide blends.

A better understanding of the mechanisms involved in the present invention can be obtained by reference to the following example of the steps involved in the formation of a glassy network of $SiO_2$ on a titanium ground plane.

In a first step of the process, TEOS is hydrolyzed in water and diluted with an aqueous/alcohol solution in the presence of a catalyst under acidic or basic conditions as follows:

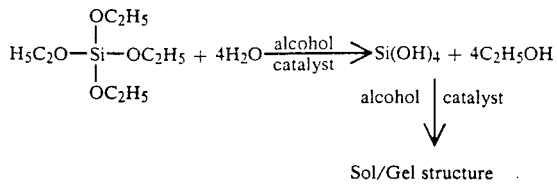

Since the hydrolysis rate is fast and goes to completion, the fully hydrolyzed species $Si(OH)_4$ formed will spontaneously proceed to undergo condensation to form a sol-gel structure. The hydrolyzed TEOS may be solution cast on the Ti ground plane prior to condensation or after condensation has begun. After casting the solution on the Ti substrate, additional condensation occurs within the hydrolyzed TEOS and between it and the Ti ground plane upon heating/drying. This condensation produces chemical bonding between the Ti oxide and the glassy network of $SiO_2$:

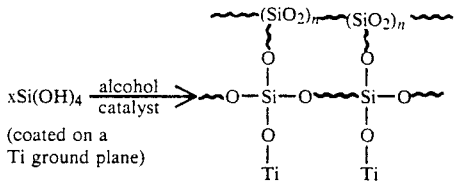

The above representation shows a specific metal oxide ($SiO_2$) layer formed on a Ti substrate. Of course, the invention is not limited to the materials specifically detailed.

As illustrated in the Figure, a photoresponsive imaging member of the present invention may comprise a supporting substrate 2 comprising, e.g., Mylar, a ground plane layer 3 of e.g. titanium, a hole blocking layer 4 of metal oxide of the invention, an adhesive layer 5 comprised of, e.g., DuPont 49,000, a photogenerating layer 6 comprised of, e.g., trigonal selenium photogenerating pigments 8 optionally dispersed in a resinous binder 9, a charge transport layer 7 comprised of, e.g., an aryl amine charge transport material dispersed in a Makrolon polycarbonate resin binder 10, and an anti-curl layer 1.

In one embodiment, with the imaging member of the present invention, $SiO_2$ is selected as the metal oxide of the hole blocking layer. This imaging member produces excellent electrical characteristics to give a dark decay rate of −151 volts per second, a cycle down after 50,000 imaging cycles of −61 volts, and a residual change of 7 volts. These electrical characteristics are determined at about 5 percent relative humidity with a xerographic testing scanner. Also, the photosensitivity of the imaging members of the present invention is excellent, for example the specific aforementioned imaging member has an $E_{\frac{1}{2}}$ of 1.7 ergs/cm$^2$.

The invention will now be illustrated with respect to specific preferred embodiments thereof, it being understood that these examples are intended to be illustrative only and that the invention is not intended to be limited to the materials, conditions, process parameters and the like recited therein.

COMPARATIVE EXAMPLE I

A photoresponsive imaging member is prepared by providing a 3 mils substrate of polyester, available from ICI Inc. The substrate is vacuum coated with titanium to form a ground plane having a thickness of about 0.02 micrometers. With a 0.5 mil gap Bird applicator, a solution of 1 gram of hydrolyzed 3-aminopropyltriethoxy silane (available from Union Carbide Corporation), 0.3 gram of acetic acid, and 94.7 grams of 200 proof denatured alcohol (Ethanol Formula 3A from J-T Baker Chemical Company) is applied to the ground plane to form a hole blocking layer. This hole blocking layer is dried for 5 minutes at room temperature, and then cured for 10 minutes at 135° C. in a forced air oven to give a dry film thickness of 0.05 micrometer.

There is then applied to the hole blocking layer with a Bird applicator a coating with a wet thickness of 0.5 mil and containing 5 weight percent based on the weight of an entire solution of 49,000 copolyester, available from du Pont Chemical, in a 70:30 mixture of tetrahydrofuran/cyclohexanone. The resultant adhesive layer is allowed to dry for one minute at room temperature, and 5 minutes at 135° C. in a forced air oven. The adhesive layer has a dry thickness of 0.05 micrometer.

A photogenerating material is coated over the adhesive to give a dry layer containing 7.5 percent by volume of trigonal selenium, 25 percent by volume of N,N'-diphenyl-N,N'-bis (3-methylphenyl)-1,1'-biphenyl-4,4-diamine, and 67.5 percent by volume of polyvinylcarbazole. This material is prepared by introducing 0.8 gram of polyvinylcarbazole and 14 milliliters of a 1:1 volume mixture of tetrahydrofuran and toluene in a 2 ounce amber bottle. To this solution is added 0.8 gram of trigonal selenium and 100 grams of ⅛ inch diameter stainless steel shot. The resulting mixture is then placed on a ball mill for 96 hours. Subsequently, 5 grams of the resulting slurry are added to a solution of 0.36 gram of polyvinylcarbazole and 0.20 gram of N,N'-diphenyl-N,N'-bis(3-methylphenyl)-1,1'-biphenyl -4,4-diamine, in 7.5 milliliters of a 1:1 volume ratio of tetrahydronfuran/toluene. The resulting slurry is then placed on a paint shaker for 10 minutes. The resulting slurry is then applied to the adhesive layer with a Bird applicator to form a layer with a wet thickness of 0.5 mil. This layer is then dried at 135° C. for 5 minutes in a forced air oven to form the photogenerating layer with a thickness of 2.0 micrometer.

A hole transport material is prepared by introducing into an amber glass bottle in a weight ratio of 1:1 N,N'-diphenyl-N,N'-bis(3-methylphenyl)-1,1'-biphenyl -4,4-diamine, and the binder resin Makrolon 5705, a polycarbonate having a weight average molecular weight of from about 50,000 to about 100,000, available from Farbenfabricken Bayer AG. The resulting mixture is dissolved in methylene chloride to provide a 15 weight percent solution thereof. This solution is then applied to the photogenerator layer with a Bird applicator to form a hole transport layer thereon with a dry thickness of 24 micrometers. During this coating process the relative humidity is maintained at about 14 percent. The resulting photoconductive member is then annealed at 135° C. in a forced air oven for 5 minutes.

An anticurl coating material is then prepared by combining 8.82 grams of the above Makrolon polycarbonate, 0.71 gram of Vitel PE 200 polyester resin available from Goodyear Chemical, and 97.55 grams of methylene chloride in a glass bottle to form a coating solution containing 8.9 weight percent solids. The glass bottle is tightly covered and placed on a roll mill for about 24 hours until the polycarbonate and the polyester are dissolved in the methylene chloride. The resulting anticurl coating solution is applied to the back surface of the Mylar substrate with a Bird applicator and the resulting member is then dried for 5 minutes at 135° C. in a forced air oven, resulting in a thin anticurl layer of 13.5 micrometers.

The fabricated imaging member is electrically tested by negatively charging it with a corona, and discharging it by exposing it to white light of wavelengths of from 400 to 700 nanometers under 5 percent relative humidity and at 21° C. Charging is accomplished with a single pin corotron, and the charging time is 33 milliseconds. The acceptance potential of this imaging member after charging, and its residual potential after exposure are recorded. The procedure is repeated for different exposure energies supplied by a 250 watt xenon arc lamp of incident radiation, and the exposure energy required to discharge the surface potential of the member to half of its original value is determined. This surface potential is measured with a standard xerographic scanner.

The above imaging member is negatively charged to a surface potential of 900 volts, and discharged to a residual potential of 34 volts. The dark decay rate of this device is about −153 volts/second. Further, the electrical properties of the photoresponsive imaging member are very stable and show only little change (−65 volts cycle down) after 50,000 cycles of repeated charging and discharging. The 50,000 cycles residual potential change of this member is 6 volts, and the $E_{\frac{1}{2}}$ is 1.7 erg/cm$^2$. No delamination occurs.

COMPARATIVE EXAMPLE II

A layered photoresponsive imaging member is fabricated by repeating the procedure of Example I with the exception that the hole blocking triethoxysilane layer is omitted. This imaging member has a dark decay rate of −311 volts/second, a cycle down after 50,000 imaging cycles of −333 volts, a 50,000 cycles residual potential change of 11 volts and an $E_{\frac{1}{2}}$ of 1.7 ergs/cm$^2$. No delamination occurs. The exhibiton of high dark decay rate and large cycle down of the photoresponsive imaging member having no hole blocking layer is due to charge injection from the titanium conductive ground plane.

EXAMPLE III

A layered photoresponsive imaging member is prepared by repeating the procedure of Comparative Example I with the exception that the triethoxysilane hole blocking layer is replaced by a metal oxide film comprised of $SiO_2$ glassy network. The coating of this metal oxide $SiO_2$ over the titanium conductive ground plane is carried out by:

(1) Hydrolyzing 1.0 gram of tetraethylorthosilicate (TEOS) with 4.0 grams of water under stirring for four hours.

(2) Adding 0.3 gram of acetic acid with stirring for 10 minutes to facilitate spontaneous polymerization of the hydrolyzed species into extended molecules with branched side chains. This chemical reaction regenerates water molecules.

(3) Diluting the mixture with 94.7 grams of 200 proof denatured alcohol (Ethanol Formula 3-A) from J. T. Baker Chemical Company to form a loosely crosslinked sol-gel structure.

(4) Coating the final solution, which contains 1 weight percent TEOS, over a titanium/PET ground plane/substrate using a 0.5 mil gap Bird applicator.

The coated wet film is allowed to dry at room temperature for 5 minutes, and then for 10 minutes at 135° C. in a forced air oven. The resulting $SiO_2$ hole blocking layer has a dried film thickness of 0.05 micrometer. The adhesion of the $SiO_2$ layer with the conductive ground plane surface is established through the formation of Si-O-Ti bonds. The resulting imaging member tested for electrical properties has a dark decay rate of −151 volts/second, a cycle down after 50,000 imaging cycles of −61 volts, a 50,000 cycles residual potential change of 7 volts and an $E_{\frac{1}{2}}$ of 1.7 ergs/cm$^2$. These electrical results indicate that the coated ($SiO_2$) film is an excellent hole blocking layer in preventing any substantial hole injection through the conductive ground plane during cyclic imaging tests seen in Example II. In comparison to Example I, the $SiO_2$ of the present invention is a more effective hole blocking layer than the 3-aminopropyl triethoxy silane counterpart. No photoreceptor delamination (separation of layers) is observed. This indicates that the $SiO_2$ has characteristics for forming strong metal-oxygen-silicon bonds with the titanium ground plane, and promotes good interfacial adhesion with the 49,000 adhesive layer.

EXAMPLE IV

A layered photoresponsive imaging member is prepared by repeating the procedure of Example III, with the exception that a solvent mixture consisting of 74.7 grams of denatured alcohol and 20 grams of heptane, instead of 94.7 grams of denatured alcohol, is used for solution dilution. The introduction of heptane for the metal oxide and sol-gel solution preparation is to enhance the solution's wetting capability over the surface of the titanium ground plane. The addition of heptane in solution preparation is seen to yield a dry $SiO_2$ film with improved surface uniformity and smoothness. No delamination occurs.

EXAMPLE V

A layered photoresponsive imaging member is prepared by repeating the procedure described in Example III except that the $SiO_2$ hole blocking layer is modified to form a $SiO_2$-$TiO_2$ metal oxide blend. Tyzor TBT (tetra-n-butyl titanate or $Ti(OC_4H_9)_4$, from E.I. du Pont de Nemours & Company) is added to TEOS, and the use of acid catalyst is omitted due to the high reactivity of the titanate such that polymerization and crosslinking processes to form the sol-gel structure are autocatalyzed. The preparation of the metal oxide blend hole blocking layer material is carried out by:

(1) Hydrolyzing 0.7 gram of TEOS in 4.0 grams of water with stirring for four hours.

(2) Adding 0.3 gram of Tyzor TBT titanate to the mixture with stirring for 10 minutes.

(3) Diluting the hydrolyzed TEOS/TBT mixture with 94.7 grams of denatured alcohol to form a loosely crosslinked $SiO_2$-$TiO_2$ sol-gel structure.

This final solution is cast onto a titanium/PET ground plane/substrate using a 0.5 mil gap Bird applicator. The coated wet film is allowed to dry for 5 minutes at room temperature and then 10 minutes at 135° C. in a forced air oven. The resulting $SiO_2$-$TiO_2$ hole blocking layer has a 0.05 micrometer dried film thickness. This imaging member has a dark decay rate of −154 volts/-second, a cycle down after 50,000 imaging cycles of −66 volts, a 50,000 cycles residual potential change of 7 volts and an $E_{\frac{1}{2}}$ of 1.8 ergs/cm$^2$, comparable to the results observed for Example I. No delamination occurs.

Although the invention has been described with reference to specific preferred embodiments, it is not intended to be limited thereto. Those skilled in the art will recognize that variations and modifications may be made therein which are within the spirit of the invention and within the scope of the claims.

What is claimed is:

1. An electrophotographic imaging member comprising a hole blocking layer, said hole blocking layer comprising a glassy network of metal oxide.

2. The member of claim 1, wherein said glassy network of metal oxide is obtained by hydrolyzing a metal alkoxide or aryloxide of the formula $M(OR)_4$, wherein M is a metal and R is an alkyl having from 1 to 20 carbon atoms, benzyl or phenyl, and condensing said hydrolyzed metal alkoxide or aryloxide.

3. The member of claim 1, wherein said hole blocking layer is covalently bonded to an adjacent layer.

4. The member of claim 1, wherein said glassy network of metal oxide is covalently bonded to a metal in an adjacent layer.

5. The member of claim 1, wherein said metal is at least one metal selected from the group consisting of Si, Ti, Al, Cr, Sn, Fe, Mg, Mn, Zr, Ni, and Cu.

6. The member of claim 2, wherein said adjacent layer comprises Ti.

7. The member of claim 1, wherein said metal alkoxide of the formula $M(OR)_4$ is tetraethylorthosilicate.

8. The member of claim 1, wherein said hole blocking layer has a thickness of about 0.003 micrometer to about 0.5 micrometer.

9. An electrophotographic imaging member comprising a supporting substrate, a conductive ground plane, a hole blocking layer comprising a glassy network metal oxide film covalently bonded to the conductive ground plane, an adhesive interface layer, a photogenerating layer and a charge transport layer.

10. The member of claim 9, further comprising an anticurl layer coated at a backside of the supporting substrate and opposite said other layers.

11. The member of claim 9, wherein said hole blocking layer is obtained by hydrolyzing a metal alkoxide or aryloxide of the formula $M(OR)_4$, wherein M is a metal and R is an alkyl having from 1 to 20 carbon atoms, benzyl or phenyl, and condensing said hydrolyzed metal alkoxide or aryloxide to obtain said glassy network metal oxide film.

12. A method of covalently bonding adjacent layers in an electrophotographic imaging member, comprising:

(a) hydrolyzing a solution containing a metal alkoxide or aryloxide of the formula $M(OR)_4$, wherein M is a metal and R is an alkyl having 1 to 20 carbon atoms, benzyl or phenyl, to form a solution containing a hydrolyzed metal species;

(b) coating said solution containing a hydrolyzed metal species on a first layer comprising a material reactive with said hydrolyzed metal species; and (c) condensing and covalently bonding said hydrolyzed metal species with said reactive material of said first layer to form a second layer coated on said first layer.

13. The method of claim 12, wherein said condensing is carried out in an acid medium.

14. The method of claim 12, wherein said condensing is carried out in a basic medium.

15. The method of claim 12, wherein said reactive material is a metal.

16. The method of claim 12, further including the step of drying the covalently bonded layers at elevated temperatures.

17. The method of claim 12, wherein said solution containing said metal alkoxide or aryloxide is an aqueous/alcohol solution.

18. The method of claim 12, wherein said second layer is a hole blocking layer.

19. The method of claim 18, wherein said first layer is a conductive ground plane layer.

20. The method of claim 18, wherein said first layer is a substrate layer.

* * * * *